US007479741B2

(12) United States Patent
Haener et al.

(10) Patent No.: US 7,479,741 B2
(45) Date of Patent: Jan. 20, 2009

(54) METHOD AND DEVICE FOR SUPPLYING POWER TO LEDS

(75) Inventors: Lukas Haener, Duebendorf (CH); Juerg Fries, Zurich (CH)

(73) Assignee: DSP Group Switzerland AG, Zurich (CH)

( * ) Notice: Subject to any disclaimer, the term of this patent is extended or adjusted under 35 U.S.C. 154(b) by 0 days.

(21) Appl. No.: 10/564,534

(22) PCT Filed: Jun. 28, 2004

(86) PCT No.: PCT/IB2004/002155

§ 371 (c)(1),
(2), (4) Date: Jan. 12, 2006

(87) PCT Pub. No.: WO2005/009086

PCT Pub. Date: Jan. 27, 2005

(65) Prior Publication Data

US 2006/0234779 A1 Oct. 19, 2006

(30) Foreign Application Priority Data

Jul. 16, 2003 (EP) ..... 03300061

(51) Int. Cl.
*G05F 1/00* (2006.01)

(52) U.S. Cl. ..... 315/291; 315/244; 315/247

(58) Field of Classification Search ..... 315/250, 315/255, 324, 346, 209 R, 225, 247, 291, 315/307, 224, 242, 258; 363/21, 49; 362/183, 362/184, 800

See application file for complete search history.

(56) References Cited

U.S. PATENT DOCUMENTS

| | | | | |
|---|---|---|---|---|
| 5,041,956 | A * | 8/1991 | Marinus | 363/21.16 |
| 6,095,661 | A * | 8/2000 | Lebens et al. | 362/184 |
| 6,320,330 | B1 * | 11/2001 | Haavisto et al. | 315/291 |
| 6,459,218 | B2 * | 10/2002 | Boys et al. | 315/324 |
| 6,690,121 | B1 * | 2/2004 | Weindorf | 315/247 |
| 6,798,801 | B2 * | 9/2004 | Johnson | 372/38.02 |
| 6,980,119 | B2 * | 12/2005 | Toulmin et al. | 340/815.45 |
| 7,071,762 | B2 * | 7/2006 | Xu et al. | 327/423 |
| 7,178,971 | B2 * | 2/2007 | Pong et al. | 315/291 |

* cited by examiner

*Primary Examiner*—Douglas W Owens
*Assistant Examiner*—Jimmy T Vu
(74) *Attorney, Agent, or Firm*—Connolly Bove Lodge & Hutz LLP

(57) ABSTRACT

The invention relates to a device for lighting at least one light emitting diode to be supplied with predefined minimum forward voltage and maximum current. It comprises: —voltage supply means for supplying voltage to the light emitting diode, —a pulse generator for generating a cyclic pulse signal having predefined on-times and off-times, —a switch, controlled by the pulse generator to be turned on during said on-times to short-circuit the light emitting diode and turned off during said off-times, —an inductive device for increasing the forward voltage over the light emitting diode when the switch is turned off, so that said forward voltage gets higher that the minimum forward voltage and for decreasing said forward voltage when the switch is turned on, so that the current through the light emitting diode remains below the maximum current.

8 Claims, 1 Drawing Sheet

METHOD AND DEVICE FOR SUPPLYING POWER TO LEDS

FIELD OF THE INVENTION

The invention generally relates to mobile communications. It particularly relates to a device and method for generating appropriate supply for LEDs (Light Emitting Diodes), which need to be supplied with a forward voltage that is higher than a predefined minimum forward voltage and with a current that is lower than a predefined maximum current.

The invention advantageously applies to any voltage-supplied equipment and especially to battery-supplied equipment, like mobile phones or PDAs (Personal Digital Assistant), for example, having color displays that are backlighted using white LEDs.

BACKGROUND OF THE INVENTION

LEDs need to be supplied with appropriate forward voltage and current limitation. In particular, white LEDs may need a higher forward voltage than the voltage supplied in current battery driven equipment. Known direct current up or down voltage converters, also called DCDC up-converters, with current measurement can be used for this purpose. But they are rather expensive.

OBJECT AND SUMMARY OF THE INVENTION

It is an object of the invention to provide cost-effective supply generation means for LEDs.

To this end, a device and a method as defined in the opening paragraph are described. The device comprises:

- voltage supply means for supplying voltage to the LEDs,
- a pulse generator for generating a cyclic pulse signal having predefined on- times and off-times,
- a switch controlled by the pulse generator to be turned on during said on-times to short-circuit the LEDs and turned off during said off-times,
- an inductive device for increasing the forward voltage over the LEDs when the switch is turned off, so that said forward voltage gets higher than the minimum forward voltage and for decreasing said forward voltage when the switch is turned on, so that the current through the LEDs remains below the maximum current.

This arrangement allows supplying the LEDs with sufficient forward voltage and prevents the current flowing through the leds to be too high. The pulse generator can be for example a PWM (Pulse Width Modulation) generator. It is often available in current battery-supplied equipment. Therefore, the circuit can be built at very low cost with very few extra components. No special regulation is required provided a trade off between the inductance of the inductive device and the frequency of the pulse generator is achieved with respect to the brightness required from the LEDs.

BRIEF DESCRIPTION OF THE DRAWINGS

The invention and additional features, which may be optionally used to implement the invention, are apparent from and will be elucidated with reference to the drawings described hereinafter, wherein.

DETAILED DESCRIPTION OF THE DRAWINGS

The following remarks relate to reference signs. Like letter references in all Figures designate like entities.

Current batteries do not provide a voltage that is high enough for white LEDs. However, white LEDS cannot be supplied with a too high current. A trade off between a high voltage and a low current must be achieved. Therefore, a device is needed to increase the voltage over the LEDs without increasing the current over the maximum current that the LEDs can bear.

Figure 1:
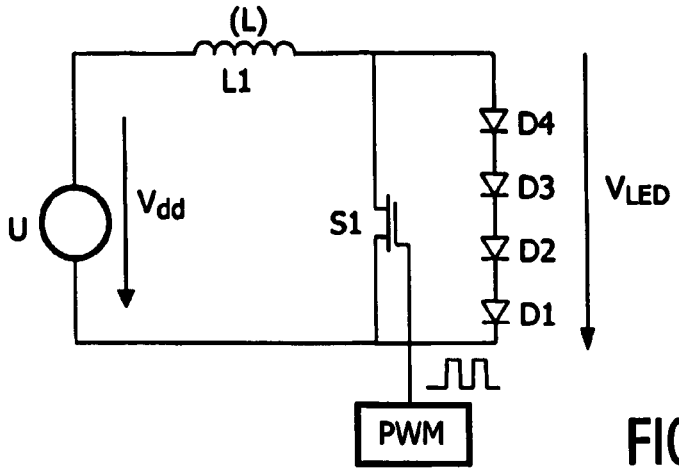
FIG. 1 is a schematic diagram illustrating a device according to the invention.

FIG. 1 is an example of a device according to the invention for lighting white LEDs that need to be supplied with a certain predefined reference minimum forward voltage, but also with a current that should be below a predefined reference maximum current. Depending on the application and on the voltage needed, one or several LEDs can be used in series. The application comprises:

- the LEDs D1 to D4,
- voltage supply means U for supplying a voltage to the LEDs,
- a pulse generator PWM for generating a cyclic pulse signal having predefined on-times when the signal is at its higher state and off-times when the signal is in its lower state, the pulse generator can be a pulse width modulation generator but not necessarily,
- a switch S1, for example an NMOS FET (Field Effect Transistor conducting current when the gate is driven to a more positive voltage than the source) or NPN bipolar transistor (transistor which is turned on by a positive current in the base, which then allows to conduct current from collector to base) controlled by the pulse generator to be turned on during said on-times to charge the inductance L1 and short circuit the LEDs and turned off during said off-times,
- an inductive device or coil L1 having an inductance L for increasing the forward voltage over the LEDs when the switch is turned off, so that the forward voltage gets higher than the minimum forward voltage and for charging L1 when the switch is turned on, so that the current through the LEDs remains below the reference maximum current.

The supply U has the voltage Vdd. The switch S1 is turned on (is conducting) during the on times of the pulse generator. When S1 is conducting, the coil L1 increases its current by Vdd/L. When S1 is turned off, the current keeps on flowing through the coil L1 and the coil current is decreased by (VLED−Vdd)/L.

The maximum on-time of the signal PWM and the inductance L of the coil L1 has to be chosen so that the maximum coil current is not higher than the maximum current allowed through the LEDs. The off-time has to be chosen so that the oil current decreases to 0. If the PWM signal is turned off, the LEDs also turn off. The frequency of the pulse generator has an impact on the brightness of the LEDs. The higher the frequency is, the brighter the LEDs are, because the pulse signal makes the LEDs light up or not according to the pulse signal frequency. At high frequencies, a human eye cannot see the LEDs flickering. But they are indeed lit on only part of the time, that is only during the off-times of the pulse signal, which causes their brightness to be a bit lower than if they were on all the time.

Figure 2:
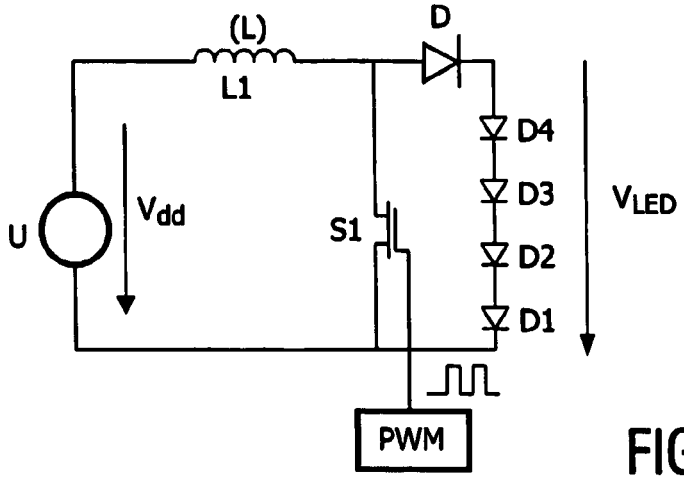
FIG. 2 is a schematic diagram illustrating an improved device according to the invention.

To improve efficiency of the circuit, a diode D can be used before the LEDs as shown in FIG. 2 to prevent the voltage over the LEDs from dropping to zero.

Figure 3:
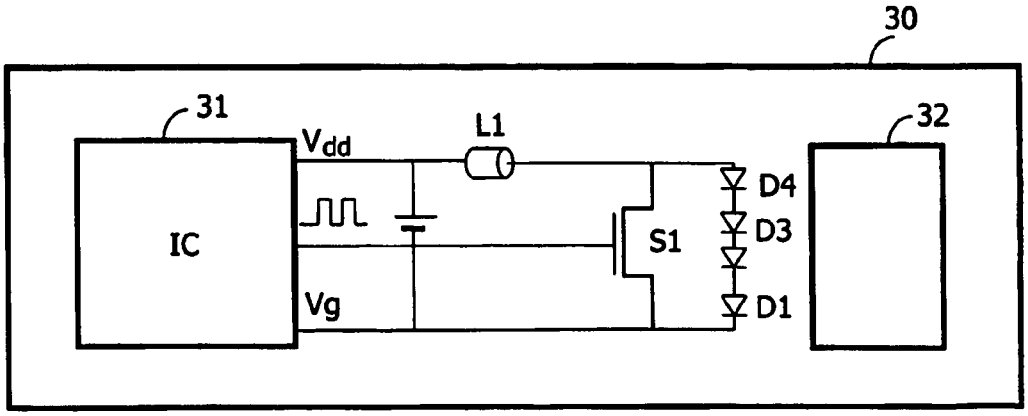
FIG. 3 is a schematic diagram for illustrating an apparatus including a device according to the invention.

FIG. 3 illustrates a mobile phone apparatus 30 having an IC 31 containing a pulse generator and a color display 32, which is back lighted with the white LEDs D1 to D4, using a device as shown in FIG. 1 or FIG. 2. In FIG. 3, Vg stands for ground.

The drawings and their descriptions hereinbefore illustrate rather than limit the invention. It will be evident that there are numerous alternatives, which fall within the scope of the appended claims.

The invention claimed is:

1. A device for lighting at least one light emitting diode (LED) to be supplied with predefined minimum forward voltage and maximum current, comprising:

a battery having a voltage less than said predefined minimum forward voltage for supplying voltage to the light emitting diode, a pulse generator for generating a cyclic pulse signal having predefined on-times and off-times, a switch controlled by the pulse generator to be turned on during said on-times to short-circuit the light emitting diode and turned off during said off-times, an inductive device for being charged when the switch is turned on and for increasing the forward voltage over the light emitting diode when the switch is turned off, wherein the pulse generator is a pulse width modulation generator, wherein the inductive device is a coil having an inductance defined by the number of light emitting diodes and maximum current and voltage requirements of said light emitting diodes and available frequency of the pulse generator.

2. A device as claimed in claim 1, comprising a diode before the light emitting diode to prevent the voltage over the light emitting diode from going down to zero.

3. A device as claimed in claim 1, wherein the cyclic pulse signal has a frequency from 0.1 kHz to 30 Mega hertz.

4. A device as claimed in claim 1, wherein the switch is a MOS FET or an NPN bipolar.

5. A battery-supplied apparatus comprising a display and a device as claimed in claim 1 for backlighting said display.

6. A method of lighting at least one light emitting diode to be supplied with predefined minimum forward voltage and maximum current, comprising the steps of:

supplying a forward voltage to the light emitting diode, using a battery having a voltage less than said predefined minimum forward voltage, using a pulse width modulator to generate a cyclic pulse signal having predefined on-times and off-times for controlling a switch to be turned on during said on-times to short-circuit the light emitting diode and turned off during said off-times, charging an inductive device when the switch is turned on, increasing the forward voltage over the light emitting diode when the switch is turned off so that said forward voltage gets higher than the minimum forward voltage, wherein the inductive device is a coil having an inductance defined by the number of light emitting diodes and maximum current and voltage requirements of said light emitting diodes and available frequency of the pulse generator.

7. A device for lighting at least one light emitting diode (LED) to be supplied with predefined minimum forward voltage and maximum current, comprising:

a battery having a voltage less than said predefined minimum forward voltage for supplying voltage to the light emitting diode, a pulse generator for generating a cyclic pulse signal having predefined on-times and off-times, a switch controlled by the pulse generator to be turned on during said on-times to short-circuit the light emitting diode and turned off during said off-times, an inductive device for being charged when the switch is turned on and for increasing the forward voltage over the light emitting diode when the switch is turned off, wherein the pulse generator is a pulse width modulation generator, wherein said device is adapted to regulate the current over the light emitting diode by pre-defining the timing of the pulse signal that determines the charge on the inductive device, wherein the maximum on-time keeps the current of the inductive device not higher than the maximum current allowed through the light emitting diode, and the off time is chosen so that the current on the inductive device will decrease to zero.

8. A method of lighting at least one light emitting diode to be supplied with predefined minimum forward voltage and maximum current, comprising:

supplying a forward voltage to the light emitting diode, using a battery having a voltage less than said predefined minimum forward voltage, using a pulse width modulator to generate a cyclic pulse signal having predefined on-times and off-times for controlling a switch to be turned on during said on-times to short-circuit the light emitting diode and turned off during said off-times, charging an inductive device when the switch is turned on, increasing the forward voltage over the light emitting diode when the switch is turned off so that said forward voltage gets higher than the minimum forward voltage, regulating the current over the light emitting diode by pre-defining the timing of the pulse signal that determines the charge on the inductive device, wherein the maximum on-time keeps the current of the inductive device not higher than the maximum current allowed through the light emitting diode, and the off time is chosen so that the current on the inductive device will decrease to zero.

* * * * *